United States Patent [19]

Morin et al.

[11] 4,315,831

[45] Feb. 16, 1982

[54] PROCESS FOR THE CONDITIONING OF SOLID RADIOACTIVE WASTE WITH LARGE DIMENSIONS

[75] Inventors: Bruno Morin, Grenoble; Daniel Thiéry, Saint Martin d'Heres, both of France

[73] Assignee: Commissariat a l'Energie Atomique, Paris, France

[21] Appl. No.: 822,317

[22] Filed: Aug. 5, 1977

[30] Foreign Application Priority Data

Aug. 13, 1976 [FR] France ..... 76 24760

[51] Int. Cl.[3] ..... G21F 9/36

[52] U.S. Cl. ..... 252/628; 264/0.5

[58] Field of Search ..... 252/301.1 W; 264/0.5

[56] References Cited

U.S. PATENT DOCUMENTS

| | | | |
|---|---|---|---|
| 3,493,531 | 2/1970 | Hofmann et al. | 264/272 |
| 3,658,750 | 4/1972 | Tsukui et al. | 260/38 |
| 3,711,432 | 1/1973 | Shah | 260/16 |
| 3,838,061 | 9/1974 | Cuaz et al. | 252/301.1 W |
| 3,935,467 | 1/1976 | Gablin | 252/301.1 W |
| 4,010,108 | 3/1977 | Gablin et al. | 252/301.1 W |
| 4,021,363 | 5/1977 | Standart et al. | 252/301.1 W |
| 4,119,560 | 10/1978 | Sheeline | 252/301.1 W |

FOREIGN PATENT DOCUMENTS

| | | | |
|---|---|---|---|
| 2251081 | 6/1975 | France . | |
| 2255683 | 7/1975 | France . | |
| 45-11280 | 9/1970 | Japan | 252/301.1 W |
| 1137849 | 12/1968 | United Kingdom . | |

OTHER PUBLICATIONS

Martino, C. F., "Phenolics, Too Good to be Outmoded", *SPE Journel,* vol. 23, No. 3 (Mar. 1967), pp. 96–101.

"Epoxy Resins", Encyclopedia of Polymer Science and Technology, Interscience Publishers, New York, 1970, vol. 6, p. 250.

Bjorksten, J., *Polyesters and Their Applications,* Reinhold Publishing Corp., N.Y., 1956 pp. 73, 90, 91, 119.

*Primary Examiner*—Deborah L. Kyle

*Attorney, Agent, or Firm*—Lane, Aitken, Kice and Kananen

[57] ABSTRACT

Process for the conditioning of solid radioactive waste with large dimensions, constituted by contaminated objects such as cartridge filters, metal chips, tools etc., wherein said waste is incorporated into an ambient temperature-thermosetting resin to which has previously been added at least one inert filler, and the said resin is then cross-linked. One application is the encasing of solid radioactive waste below water, particularly at the bottom of a pond.

2 Claims, No Drawings

PROCESS FOR THE CONDITIONING OF SOLID RADIOACTIVE WASTE WITH LARGE DIMENSIONS

BACKGROUND OF THE INVENTION

The present invention relates to a process for conditioning solid radioactive waste having large dimensions, constituted by contaminated objects such as cartridge filters, metal chips, tools, etc. Generally the activity of such solid radioactive waste does not exceed 10 Ci/m$^3$.

Hitherto the conditioning of large radioactive waste, such as that defined hereinbefore, has taken place by encasing in concrete blocks. Encasing in concrete has been carried out either by introducing the waste into concrete vessels which were then sealed by a concrete plug, or by introducing the waste into moulds in which the concrete was then cast. This conditioning process using concrete ensures a good biological protection against ionising radiation from the thus confined waste, but due to the fact that concrete has a poor long term behaviour and a limited resistance to weather and leaching, the concrete blocks encasing the radioactive waste do not have a perfect sealing.

French Pat. No. 2,129,836 filed on Mar. 16th, 1971 by the present Applicant relates to a process for conditioning radioactive waste reduced to the form of a dry powder according to which the pulverulent radioactive waste is incorporated into a resin which is polymerisable at ambient temperature and then said resin is polymerised.

In said process the resin polymerisable at ambient temperature in particular comprises a polyester resin such as a glycol-maleophthalate-based resin mixed with styrene. Although the process described in French Pat. No. 2,129,836 has proved satisfactory in the case of pulverulent radioactive waste, it cannot be used for solids with large dimensions.

BRIEF SUMMARY OF THE INVENTION

The object of the present invention is a process which makes it possible to condition radioactive waste of large size. This process does not have the disadvantages of the conditioning process in concrete referred to hereinbefore and makes it possible to obtain blocks containing solid radioactive waste with very large dimensions whilst providing a perfect sealing. The Applicant has performed research showing that on incorporating large solid radioactive waste into a resin polymerisable at ambient temperature a shrinkage phenomenon occurs during the polymerisation of said resin which, in view of the large dimensions of the solid waste which it is desired to encase, causes the formation of cracks in the solid blocks obtained.

The process according to the invention obviates such disadvantages.

According to the process for conditioning solid radioactive waste of large size of the present invention, said waste is incorporated into an ambient temperature-thermosetting resin, to which has previously been added at least one inert filler, and the said resin is then cross-linked.

Thus, according to the process of the invention, the addition to the thermosetting resin of an inert filler makes it possible to significantly reduce shrinkage occurring at the time of cross-linking and thus obviates any dislocation or cracking in the solid blocks obtained.

This inert filler can comprise a sand such as a silica sand or blast furnace residue called slag. Preferably silica sand with a continuous grain size between 0.1 and 1.2 mm is used.

According to an advantageous feature of the process of the invention, a plasticizer such as polystyrene or polyethylene is previously added to the thermosetting resin in addition to the inert filler. This plasticizer is added in proportions preferably ranging from 0.1 to 1 part of plasticizer for 1 part of resin. The prior addition of this plasticizer to the resin leads to a further improvement of the present process due to its plastic deformation capacity. In fact it makes the resin more supple at the time of cross-linking and obviates subsequent cracking in the solid blocks obtained.

According to another advantageous feature of the process of the invention, an expanding agent, that is to say a mineral substance which has the property of expanding the resin during cross-linking is added to the thermosetting resin beforehand in addition to the inert filler. This expanding agent can comprise borax ($Na_2B_4O_7$, $10H_2O$). If such an expanding agent is added in a sufficient quantity it eliminates any supplementary risk of shrinkage and therefore subsequent cracking. The borax can be added to the resin preferably in a proportion of 30 to 60% by weight relative to the resin.

According to the process of the invention it is also possible to add beforehand to the thermosetting resin a thixotropic agent which is able to prevent a possible settling of the inert filler in the resin prior to cross-linking. This thixotropic agent can comprise, for example, a silica gel, hydrogenated castor oil or a mixture of silica gel and asbestos fibres. The thixotropic agent is preferably used in a proportion of 0.5 to 4% by weight based on the resin. The thioxotropic agent used thickens the solution which then has a viscosity such that there is sufficient time for cross-linking to take place without there being any settling.

According to the process of the invention, the ambient temperature-thermosetting resin used can advantageously comprise a polyester resin such as a glycol-maleophthalate-based resin mixed with styrene. In this case the conventional compounds necessary for ensuring copolymerisation of the styrene with the polyester and the control of the cross-linking time are used and these are mainly constituted by a catalyst such as methylethyl-ketone peroxide or benzoyl peroxide (in a proportion of 1 to 2% by weight of catalyst based on the resin), an accelerator such as cobalt naphthenate or dimethyl-aniline (in a proportion of 0.1 to 0.2% by weight based on the resin), reaction controlling agents such as retarders (catecholbased compound marketed under the trade name "NLC 10") and moderators ($\alpha$-methyl-styrene). Thus the polymerisation reaction started by the active radicals of the peroxide activated by the accelerator causes the grafting of the styrene molecules on the glycol-maleophthalate chain, followed by an arrangement in a three-dimensional network. In this case when polystyrene is added to this mixture as the plasticizer the three-dimensional network obtained is made more supple because the chains can be connected by relatively long molecules.

The use of a polyester resin as described hereinbefore offers the advantage that the large radioactive waste material can be conditioned under water, and more particularly in the pond at the bottom of which they are generally conditioned.

According to the process of the invention, it is also possible to use as the thermosetting resin an epoxy resin mixed with an appropriate hardening agent (amine, or organic acid). It is also possible to use a phenoplast resin.

The process of the invention is performed in the following manner. Firstly the encasing mixture is prepared which is constituted by the selected thermosetting resin to which has been added the inert filler and optionally the plasticizer or expanding agent and also the thixotropic agent as defined hereinbefore. This mixture is then placed in a mould containing the solid waste which it is desired to condition. Alternatively, the mixture is placed in a mould and the radioactive waste which it is desired to condition is then introduced into the same—said radioactive waste generally being in a basket which is introduced into the mould. This is followed by the cross-linking thereof.

The encasing operation can be performed either in air or under water. In the case where the process is performed under water, borax cannot be used as the expanding agent because it has the disadvantage of being water-soluble. In the case where the process is performed in air ventilation can be provided.

The mixing of the various components must be homogeneous in order to ensure good mechanical and physico-chemical qualities of the material. To this end it is possible to use a vertical turbine with four blades driven by a motor operating at 0 to 400 r.p.m.

There must be sufficient time to place the solid radioactive waste in the resin before it sets solid. Therefore the time at which the polymerisation catalyst/accelerator mixture is introduced into the resin is forecasted and adjusted. The time necessary for the resin to set solid is also a function of the temperature at which the reaction is performed (for the same proportions of the reactive mixture, two or three minutes are required to obtain solid setting when the ambient temperature is 25° C., whereas more than 24 hours are required when the ambient temperature is below 16° C.).

A number of examples illustrating the process of the invention are given hereinafter in a non-limitative manner.

EXAMPLE 1

About 60 liters of solid radioactive waste are to be dry-encased.

The following are introduced into a cylindrical mould:

- 130 kg of a glycol-maleophthalate-based polyester resin dissolved in styrene, marketed under the trade name "NS 574" by the CDF Chimie Company;
- 150 kg of silica sand of grain size ranging between 0.1 and 1.2 mm;
- 70 kg of borax ($Na_2B_4O_7$, 10 $H_2O$);
- 2.5 kg of silica gel;
- 1.95 kg or 1.5% by weight based on the resin of methyl-ethyl-ketone peroxide.

The complete mixture is mixed homogeneously for 20 minutes, followed by the addition of 120 g or 0.8% by weight based on the resin of cobalt naphthenate.

The basket containing 60 liters of solid radioactive waste is then introduced and cross-linking takes place.

A homogeneous block is obtained without cracks whose diameter is 60 cm, height 77 cm and volume 220 liters.

Polymerisation shrinkage is small and no cracks are encountered.

EXAMPLE 2

60 Liters of solid radioactive waste contained in a basket are encased under water, said basket being placed at the bottom of a conditioning pond.

The following are introduced into a mould:

- 130 kg of polyester resin "NS 574";
- 150 kg of silica sand, grain size 0.1 to 1.2 mm;
- 23 kg of polystyrene in the form of balls;
- 700 g of silica gel;
- 1.95 kg of methyl-ethyl-ketone peroxide;
- 350 g of a retarding agent marketed under the trade name "NLC 10" by the Akzo France Company.

The whole mixture is mixed for 30 minutes, followed by the addition of 130 g of cobalt naphthenate. Mixing is then continued for a further 15 minutes.

The mould containing this mixture is then introduced into the pond vessel at a depth of about three meters. The basket containing the solid waste is then introduced into the mould. 50 minutes after the introduction of the accelerator (cobalt naphthenate) the start of solid setting is observed.

The maximum temperature reached in the centre of the block is 95° C. after about five hours, and this is followed by slow cooling. After 22 hours the temperature is 50° C. Gas is given off at the time of the temperature maximum.

In this way a solid cylindrical block is obtained of volume 230 liters containing 60 liters of radioactive waste. The weight of this block is 450 kg and the weight of the waste 120 kg.

It is found that cross-linking has taken place correctly under a depth of three meters of water without any release of solid material. There is merely an evolution of gas at the time of solid setting. The block has a homogeneous appearance without cracks.

It is pointed out that the solid polystyrene used as the plasticizer has a resistance to ionising radiation which is close to that of the polyester resin used.

EXAMPLE 3

15 kg of solid radioactive waste placed in a basket at the bottom of a pond are encased under water.

The following are introduced into a mould of volume 30 liters:

- 10 kg of polyester resin "NS 574";
- 6 kg of polyethylene in the form of balls;
- 14 kg of silica sand, grain size 0.1 to 1.25 mm;
- 150 g of methyl-ethyl-ketone.

The complete mixture is mixed for 15 minutes, followed by the addition of 15 g of cobalt naphthenate, followed by further mixing for 10 minutes.

The mould containing this mixture is then placed in the pond vessel. The basket containing the solid radioactive waste is then introduced into the mould.

Polymerisation starts 15 minutes after incorporating the accelerator. A homogeneous compact block is obtained.

EXAMPLE 4

100 kg of solid radioactive waste placed in a basket are encased.

The following are introduced into a container with a volume of 100 liters:

- 40 kg of epoxy resin "LOPOX 200" (marketed by the CDF Chimie Company);
- 11 kg of hardening agent "D 544" (marketed by the CDF Chimie Company);

1.2 kg of accelerator "A 101";

75 kg of silica sand of grain size 0.1 to 1 mm;

1 kg of silica gel.

The complete mixture is mixed for 15 minutes and then the basket containing the solid radioactive waste is introduced into the container.

After a few hours a compact block is obtained. The block obtained has the same characteristics as that of Example 3.

What is claimed is:

1. A process for encasing a solid mass of radioactive waste of large dimensions comprising:

(1) premixing an ambient temperature-thermosetting resin with a cross-linking agent, a plasticizer, and an inert filler;

(2) suspending said solid radioactive waste mass in said premixed resin; and (3) cross-linking said resin, said inert filler serving to reduce shrinkage and prevent cracking during said cross-linking, wherein said radioactive mass is encased in said resin under water.

2. A process for encasing a solid mass of radioactive waste of large dimensions comprising:

(1) premixing an ambient temperature-thermosetting resin with a cross-linking agent, a plasticizer, and an inert filler;

(2) introducing said premixed resin into a mold;

(3) suspending said solid radioactive waste mass in said premixed resin within said mold; and (4) cross-linking said resin, said inert filler serving to reduce shrinkage and prevent cracking during said cross-linking, wherein said radioactive mass is encased in said resin under water.

* * * * *